US007458654B2

(12) United States Patent
Ootsuka

(10) Patent No.: US 7,458,654 B2
(45) Date of Patent: Dec. 2, 2008

(54) LIQUID EJECTION APPARATUS AND EJECTION ABNORMALITY DETERMINATION METHOD

(75) Inventor: Hiroyuki Ootsuka, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 426 days.

(21) Appl. No.: 11/391,548

(22) Filed: Mar. 29, 2006

(65) Prior Publication Data

US 2006/0268046 A1 Nov. 30, 2006

(30) Foreign Application Priority Data

Mar. 30, 2005 (JP) ..... 2005-099072

(51) Int. Cl.
*B41J 29/38* (2006.01)

(52) U.S. Cl. ..... 347/14; 347/19; 347/20

(58) Field of Classification Search ..... 347/5, 347/9, 14, 19, 17, 20
See application file for complete search history.

(56) References Cited

U.S. PATENT DOCUMENTS 5,734,391 A * 3/1998 Tanaka et al. ..... 347/14
7,249,818 B1 * 7/2007 Paasch ..... 347/19

FOREIGN PATENT DOCUMENTS

JP 5-185590 A 7/1993
JP 9-94959 A 4/1997
JP 2004-284190 A 10/2004

* cited by examiner

*Primary Examiner*—Lam S Nguyen
(74) *Attorney, Agent, or Firm*—Birch, Stewart, Kolasch & Birch, LLP

(57) ABSTRACT

The liquid ejection apparatus comprises: a liquid ejection head having a nozzle which ejects liquid, a pressure chamber which is provided correspondingly to the nozzle, and a pressure measurement device which is provided correspondingly to the pressure chamber and measures pressure in the pressure chamber; a bubble removal device which removes a bubble from the pressure chamber; an error extraction device which extracts an error in capacitance of the pressure measurement device of the pressure chamber from which the bubble has been removed by the bubble removal device; a threshold value setting device which sets a corrected threshold value to be used for determination of pressure abnormality in the pressure chamber, the corrected threshold value having been corrected for the error in the capacitance of the pressure measurement device extracted by the error extraction device; a storage device which stores the corrected threshold value set by the threshold value setting device; and a pressure abnormality determination device which performs the determination of the pressure abnormality in the pressure chamber, according to a result of comparison between a measurement result obtained from the pressure measurement device and the corrected threshold value read out from the storage device.

8 Claims, 11 Drawing Sheets

LIQUID EJECTION APPARATUS AND EJECTION ABNORMALITY DETERMINATION METHOD

BACKGROUND OF THE INVENTION

1. Field of the Invention

The present invention relates to a liquid ejection apparatus and an ejection abnormality determination method, and more particularly, to pressure abnormality determination technology which measures the pressure inside pressure chambers by means of pressure measurement elements, and detects pressure abnormality on the basis of the measurement results.

2. Description of the Related Art

In a general inkjet recording apparatus (inkjet printer), printing is carried out by ejecting ink droplets at prescribed timings, respectively, from the nozzles of the head, and depositing these ink droplets on a print recording medium, such as recording paper, on the basis of dot pattern data (namely, "dot data" or "print data") converted from image data for printing inputted from a host computer.

Inkjet recording apparatuses include single-pass printers, which record a desired image on the full surface of the print recording medium, by performing just one scanning action of a line head having a length corresponding to the width of the print recording medium, with respect to the print recording medium, and serial printers, which record a desired image on the full surface of the print recording medium by moving the print recording medium in a direction perpendicular to the breadthways direction of the print recording medium while scanning the print recording medium in the breadthways direction thereof with a head that is shorter than the width of the print recording medium.

In a single-pass method using a line head, if an ejection abnormality occurs in any particular nozzle, then band-shaped non-uniformity occurs in the recorded image, thus causing the quality of the image to decline markedly. The cause of ejection abnormality may be increase in the viscosity of the ink in the vicinity of the nozzles, occurrence of bubbles inside the pressure chambers or inside the nozzles (pressure abnormality in the pressure chambers), adherence of foreign matter (dust, paper particles, etc.) to the nozzles, and the like.

As a method of determining ejection abnormality in the nozzles, there have been proposed a method which determines the ink ejected from the nozzles optically, by means of an optical measurement element, such as a photointerrupter (see Japanese Patent Application Publication No. 9-94959), and a method which determines pressure abnormality on the basis of a pressure measurement signal obtained from pressure measurement elements, and determines ejection abnormality on the basis of these pressure abnormality (see Japanese Patent Application Publication Nos. 2004-284190 and 5-185590), and the like.

In the inkjet recording apparatus and the ink determination method for a recording apparatus described in Japanese Patent Application Publication No. 9-94959, ink droplets ejected from an inkjet head are measured by means of a photointerrupter having a light-emitting element and a light-receiving element, in such a manner that the volume of the ink droplets is measured on the basis of the amount of change in the measurement signal which corresponds to the decrease in the quantity of light reaching the light-receiving element caused by the passage of the ink droplet. However, when the ink droplet volume (dot size) is reduced in order to achieve high image resolution, then the light-emitting elements and light-receiving elements of the optical measurement elements must be disposed at high resolution accordingly, but there are limitations on the degree to which the resolution of the light-emitting elements and light-receiving elements can be raised, and furthermore, it is difficult to determine the cause of any ejection abnormality that may occur and therefore a suitable restoration process cannot be chosen (or implemented).

In the liquid droplet ejection apparatus described in Japanese Patent Application Publication No. 2004-284190, the pressure changes inside the cavities are measured by driving the actuators to a level which does not cause ejection of liquid droplets, in such a manner that ejection abnormality in the liquid ejection head can be determined from the electrical signal thus obtained, on the basis of the temporal change in the capacitance caused by the oscillation of the diaphragm. However, the temporal change in the capacitance caused by the oscillation of the diaphragm varies depending on individual differences within the diaphragm, and drift occurs due to the effects of temperature change, and the like. In order to compensate for this unevenness or drift in the capacitance, a compensatory circuit must be provided in the determination circuit. This compensatory circuit comprises a circuit for converting the capacitance to a frequency, a circuit for converting the frequency to a voltage, a waveform shaping circuit, and the like, and therefore, the circuit composition is complicated.

In the inkjet printer described in Japanese Patent Application Publication No. 5-185590, pressure sensors are provided between the diaphragms and the pressurization mechanisms of the print head, and a control unit is provided for controlling the pressurization mechanisms in such a manner that the pressures applied to the diaphragms by the pressurization mechanisms are uniform, in accordance with the measurement output of the pressure sensors. However, since the unevenness in the capacitance of the pressure sensors is not taken into account, then it may be impossible to accurately measure the movement in the diaphragm, due to the effects of the unevenness in the capacitance of the pressure sensors.

SUMMARY OF THE INVENTION

The present invention has been contrived in view of the foregoing circumstances, an object thereof being to provide a liquid ejection apparatus and an ejection abnormality determination method whereby satisfactory pressure measurement can be achieved, by taking account of unevenness between the pressure sensors.

In order to attain the aforementioned object, the present invention is directed to a liquid ejection apparatus, comprising: a liquid ejection head having a nozzle which ejects liquid, a pressure chamber which is provided correspondingly to the nozzle, and a pressure measurement device which is provided correspondingly to the pressure chamber and measures pressure in the pressure chamber; a bubble removal device which removes a bubble from the pressure chamber; an error extraction device which extracts an error in capacitance of the pressure measurement device of the pressure chamber from which the bubble has been removed by the bubble removal device; a threshold value setting device which sets a corrected threshold value to be used for determination of pressure abnormality in the pressure chamber, the corrected threshold value having been corrected for the error in the capacitance of the pressure measurement device extracted by the error extraction device; a storage device which stores the corrected threshold value set by the threshold value setting device; and a pressure abnormality determination device which performs the determination of the pressure abnormality in the pressure chamber, according to a result of comparison between a measurement result obtained from the pressure measurement device and the corrected threshold value read out from the storage device.

According to the present invention, the pressure in the pressure chamber is measured by means of the pressure measurement device, immediately after carrying out a bubble removal process, the error in the capacitance of the pressure measurement device is extracted on the basis of the measurement result (pressure measurement signal) obtained by this pressure measurement operation, and a corrected threshold value for the pressure chamber is set on the basis of this error. This corrected threshold value is stored in a storage device, and the pressure abnormality of the pressure chamber is determined on the basis of the result of a comparison between the pressure measurement signal obtained from the pressure measurement device and the corrected threshold value read out from the storage device. Consequently, it is possible to achieve satisfactory pressure abnormality determination on the basis of the threshold value which takes account of the error caused by deviation in the capacitance of the pressure measurement device.

For example, if a bubble arises in the pressure chamber, then a pressure loss occurs when ejecting liquid from the nozzle, and even if the prescribed ejection force is applied, an ejection abnormality, in which liquid is not ejected correctly from the nozzle (the ejected liquid volume is excessively small), or an ejection failure, in which liquid is not ejected at all from the nozzle, occurs. It is possible to determine the normality or abnormality of the ejection state, by determining a pressure abnormality in the pressure chamber.

Desirably, the pressure is measured by the pressure measurement device immediately after the bubble removal process has been carried out. The concept of being carried out immediately after the bubble removal process may also include the period from the completion of the bubble removal process until the performance of an ejection operation on the basis of prescribed ejection data.

Preferably, the pressure measurement device comprises a piezoelectric element.

According to this aspect of the present invention, the pressure measurement device comprises the piezoelectric element in which distortion (stress) is generated in accordance with the displacement of the pressure chamber (change in volume), and from which a signal having a voltage corresponding to this distortion is obtained. Since the error is produced in the voltage generated in accordance with the distortion of the piezoelectric element, due to the deviation in the capacitance of the piezoelectric element, then it is necessary to compensate for this deviation in the capacitance, in order to improve the accuracy of the pressure measurement in the pressure chamber.

The piezoelectric element has a structure in which a piezoelectric body is formed between two electrodes, one electrode functioning as an individual electrode from which a measurement signal is obtained, and the other electrode functioning as a common electrode connected to a reference potential. Furthermore, in a mode which comprises a pressure generating device for changing the volume of the liquid chamber (pressure chamber) in which a recording liquid is accommodated, then a piezoelectric element is also suitable for use as the pressure generating device. These piezoelectric elements may be a single-layer piezoelectric element comprising one piezoelectric body layer and two electrodes formed so as to sandwich the piezoelectric body layer, or a laminated piezoelectric element having a laminated structure comprising a plurality of piezoelectric body layers.

In order to attain the aforementioned object, the present invention is also directed to a liquid ejection apparatus, comprising: a liquid ejection head having a plurality of nozzles which eject liquid, a plurality of pressure chambers which are provided correspondingly to the nozzles, and a plurality of pressure measurement devices which are provided correspondingly to the pressure chambers and measure pressure in the pressure chambers; a selection device which selectively switches the pressure measurement devices from which measurement signals are obtained; a bubble removal device which removes bubbles from the pressure chambers; an error extraction device which extracts errors in capacitance of the pressure measurement devices of the pressure chambers from which the bubbles have been removed by the bubble removal device; a threshold value setting device which sets corrected threshold values to be used for determination of pressure abnormality in the pressure chambers, the corrected threshold values having been corrected for the errors in the capacitance of the pressure measurement devices extracted by the error extraction device; a storage device which stores the corrected threshold values set by the threshold value setting device; and a pressure abnormality determination device which performs the determination of the pressure abnormality in the pressure chambers, according to results of comparison between measurement results obtained from the pressure measurement devices and the corrected threshold values read out from the storage device.

It is also possible to extract the errors in the capacitance of the pressure measurement devices, by selectively switching which measurement signal is to be obtained, of the pressure measurement devices corresponding to the pressure chambers.

A compositional embodiment of a liquid ejection head having a plurality of nozzles (pressure chambers and pressure measurement devices) in the present invention is a full line type inkjet head having a nozzle row in which a plurality of nozzles for ejecting ink are arranged through a length corresponding to the full width of the recording medium.

In this case, a mode may be adopted in which a plurality of relatively short ejection head blocks having nozzles rows which do not reach a length corresponding to the full width of the recording medium are combined and joined together to be lengthened, thereby forming nozzle rows that correspond to the full width of the recording medium.

A full line type inkjet head is usually disposed in a direction perpendicular to the relative feed direction (relative conveyance direction) of the recording medium, but modes may also be adopted in which the inkjet head is disposed following an oblique direction that forms a prescribed angle with respect to the direction perpendicular to the relative conveyance direction.

Preferably, the threshold value setting device sets the corrected threshold values to be used for the determination of the pressure abnormality for the pressure measurement devices, respectively; and the storage device stores the corrected threshold values set for the pressure measurement devices, respectively.

According to this aspect of the present invention, the corrected threshold values corresponding to the pressure measurement devices are obtained and stored in a storage device. Therefore, when the plurality of pressure measurement devices are provided, it is still possible to achieve satisfactory determination of pressure abnormality, in all of the measurement devices, regardless of the error (deviation) in the capacitance of the pressure measurement devices.

Preferably, the threshold value setting device comprises: a reference value input section to which a reference value is inputted; an error input section to which the errors in the capacitance of the pressure measurement devices extracted by the error extraction device are inputted; and an output section which outputs the corrected threshold values obtained by calculating according to the reference value inputted to the reference value input section and the errors inputted to the error input section; and the liquid ejection apparatus further comprises: an input switching device which switches the reference value inputted to the reference value input section; an output switching device which switches destination of the corrected threshold values outputted by the output section; and a switching control device which, during an ejection operation for ejecting the liquid from the nozzles in accordance with prescribed ejection data, controls the input switching device in such a manner that the corrected threshold values read out from the storage device are inputted to the reference value input section, and controls the output switching device in such a manner that threshold values during the ejection operation outputted from the output section calculated according to the corrected threshold values inputted to the reference value input section and the errors in the capacitance of the pressure measurement devices during the ejection operation extracted by the error extraction section, are inputted to the pressure abnormality determination section.

According to this aspect of the present invention, during the ejection operation for ejecting liquid in accordance with the prescribed ejection data, the corrected threshold value corresponding to the pressure chamber stored in the threshold value storage section is read out to the reference value input section, and the threshold value during the ejection operation determined by calculation (addition or subtraction) on the basis of the reference value and the error inputted to the error input section is outputted from the output section. Therefore, even if the capacitance of the pressure measurement device changes during an ejection operation, a threshold value for the ejection operation is set so as to correct the amount of change in the capacitance of the pressure measurement device, and therefore, desirable pressure measurement can be achieved in accordance with the change in the capacitance of the pressure measurement device during an ejection operation.

Here, the term "during the ejection operation" means a state where the on and off switching of the nozzles is controlled on the basis of the prescribed ejection data, and it also includes nozzles which do not eject liquid during the ejection operation, in accordance with the ejection data.

One embodiment of a factor which causes the capacitance of the pressure generating device to change during the ejection operation is the temperature change in the pressure measurement device. In particular, in a mode where the pressure measurement device is also used as a pressure generating device, the amount of change in the temperature varies according to the printing duty, and therefore, it is necessary to correct the deviation in the capacitance of the pressure measurement device in accordance with the printing duty. Furthermore, in a mode where a plurality of pressure measurement devices are provided, if the pressure measurement devices vary in the drifts in the capacitance due to the temperature change, then there may be unevenness in the capacitance between the pressure measurement devices, even if the amount of temperature change is uniform.

In order to attain the aforementioned object, the present invention is also directed to an ejection abnormality determination method for a liquid ejection head having a nozzle which ejects liquid, a pressure chamber which is provided correspondingly to the nozzle, and a pressure measurement device which is provided correspondingly to the pressure chamber and converts pressure in the pressure chamber into a pressure measurement signal, the method comprising: a bubble removal step of removing a bubble from the pressure chamber; an error extraction step of extracting an error in capacitance of the pressure measurement device of the pressure chamber from which the bubble has been removed in the bubble removing step; a threshold value setting step of setting a corrected threshold value to be used for determination of pressure abnormality in the pressure chamber, according to the error in the capacitance of the pressure measurement device extracted in the error extraction step; a storage step of storing the corrected threshold value set in the threshold value setting step; a pressure measurement step of measuring pressure in the pressure chamber by the pressure measurement device; and a pressure abnormality determination step of performing the determination of the pressure abnormality in the pressure chamber, according to a result of comparison between a measurement result obtained in the pressure measurement step and the corrected threshold value stored in the storage step.

According to the present invention, the errors (deviations) in the capacitance of the pressure measurement devices provided in the pressure chambers are extracted by measuring the pressure inside the pressure chambers, immediately after removing the bubbles in the pressure chambers, corrected threshold values are set for the pressure measurement devices (pressure chambers) on the basis of the extracted errors of the pressure measurement devices, and pressure abnormality in the pressure chambers are determined on the basis of these threshold values corrected for deviations in the capacitance of the pressure measurement devices. Therefore, it is possible to accurately determine the presence or absence of pressure abnormality in the pressure chambers, even if there are deviations in the capacitance of the pressure measurement devices, and satisfactory determination of ejection abnormality can be achieved on the basis of the results of determining pressure abnormality.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
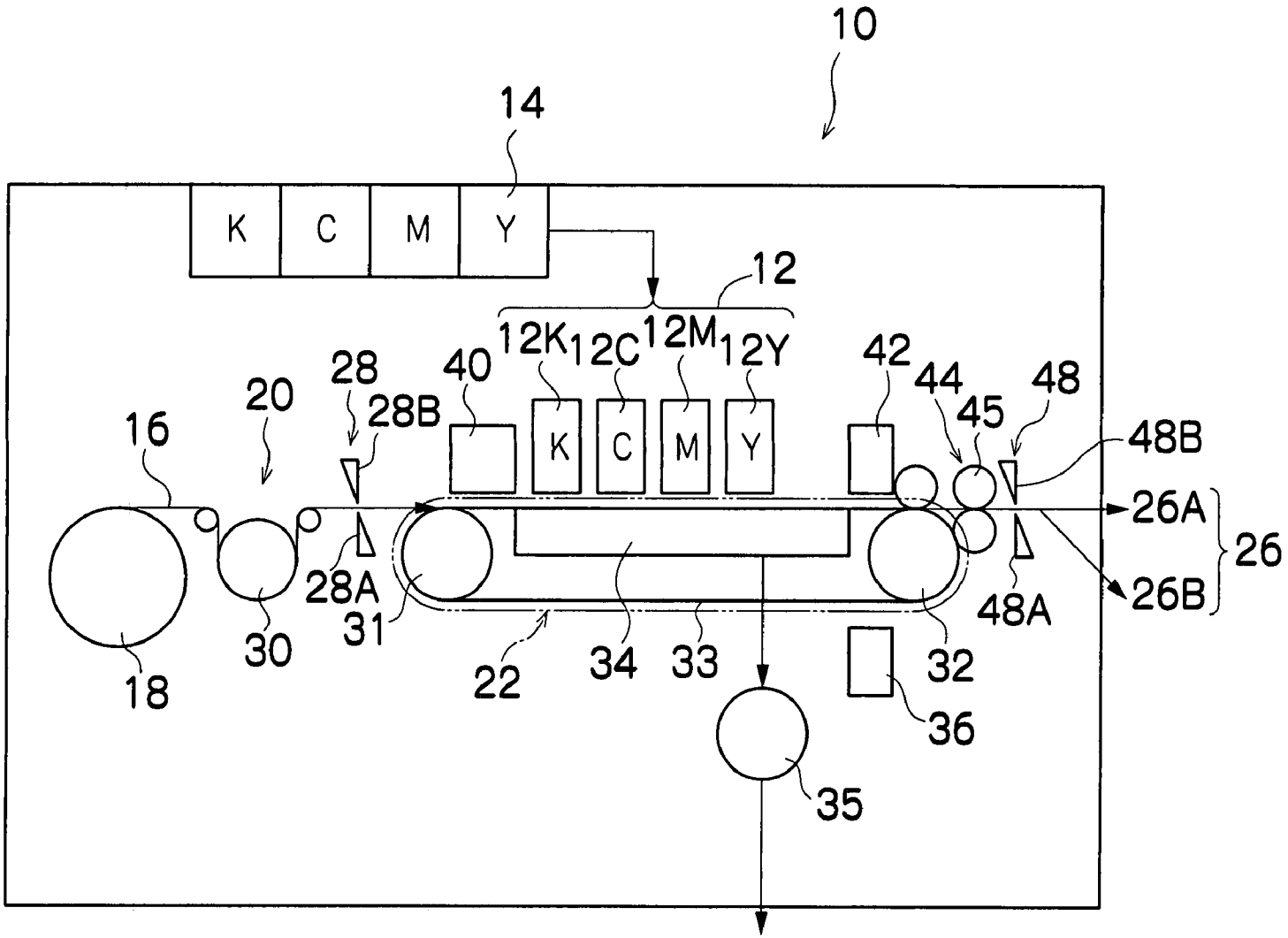
FIG. 1 is a general schematic drawing of an inkjet recording apparatus according to an embodiment of the present invention.

FIG. 1 is a general configuration diagram of an inkjet recording apparatus according to an embodiment of the present invention. As shown in FIG. 1, the inkjet recording apparatus 10 comprises: a printing unit 12 having a plurality of inkjet heads (hereafter, called "heads") 12K, 12C, 12M, and 12Y provided for ink colors of black (K), cyan (C), magenta (M), and yellow (Y), respectively; an ink storing and loading unit 14 for storing inks of K, C, M and Y to be supplied to the heads 12K, 12C, 12M, and 12Y; a paper supply unit 18 for supplying recording paper 16 which is a recording medium; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; and a paper output unit 26 for outputting image-printed recording paper (printed matter) to the exterior.

The ink storing and loading unit 14 has ink supply tanks for storing the inks of K, C, M and Y to be supplied to the heads 12K, 12C, 12M, and 12Y, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction apertures (not shown) are formed on the belt surface. A suction chamber 34 is disposed in a position facing the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
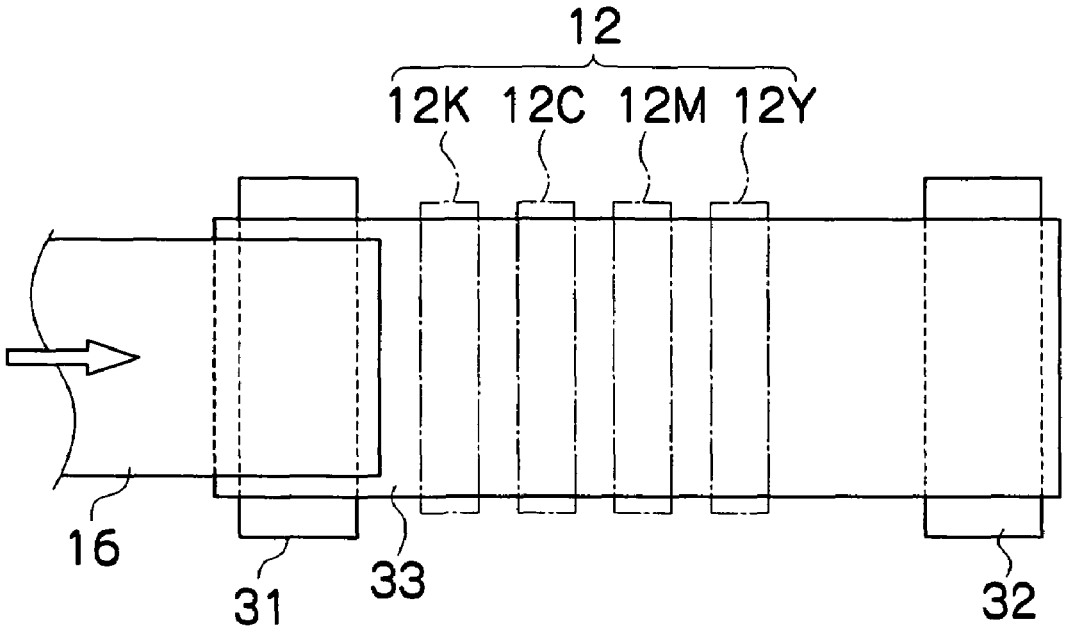
FIG. 2 is a principal plan diagram of the peripheral area of a printing unit in the inkjet recording apparatus shown in FIG. 1.

The heads 12K, 12C, 12M and 12Y of the printing unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIG. 2).

The heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the suction belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

A post-drying unit 42 is disposed following the printing unit 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Head

Next, the structure of a head is described. The heads 12K, 12C, 12M and 12Y of the respective ink colors have the same structure, and a reference numeral 50 is hereinafter designated to any of the heads.

Figure 3A:
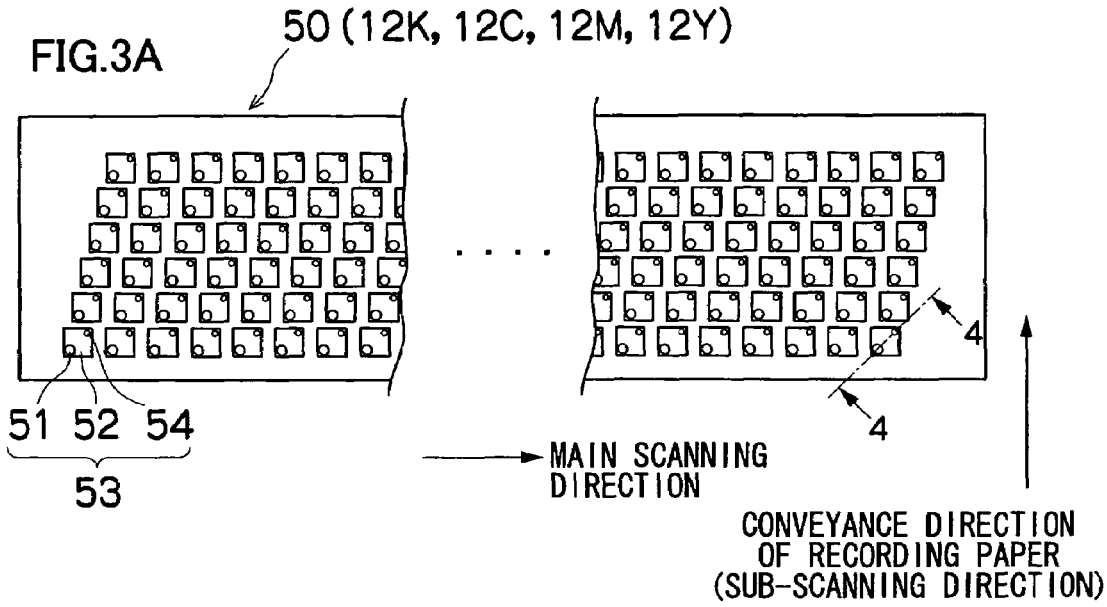
FIGS. 3A to 3C are plan view perspective diagrams showing embodiments of the composition of a print head.
Figure 3B:
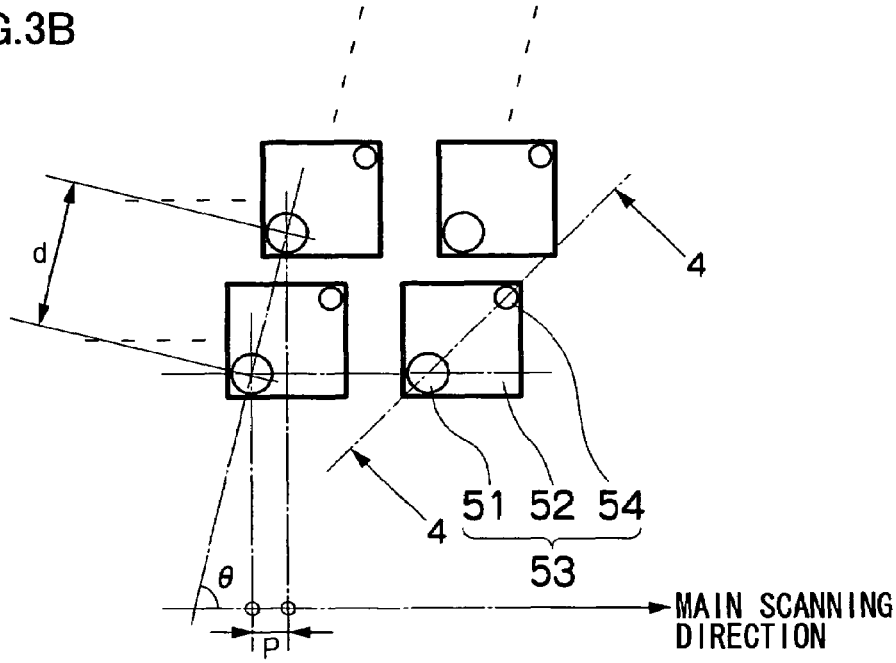
Figure 3C:
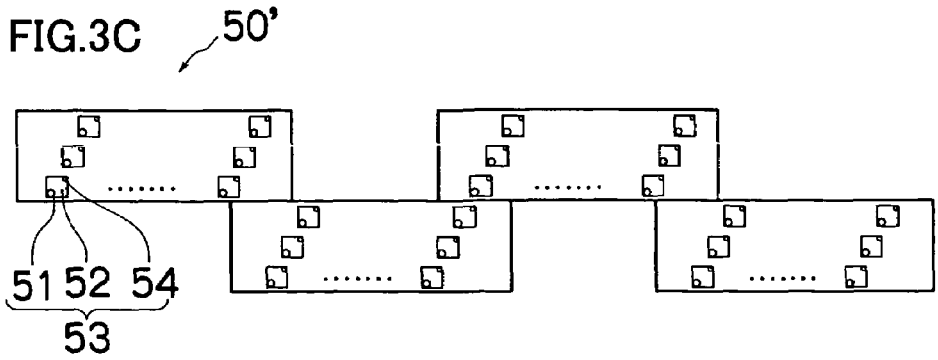
Figure 4:
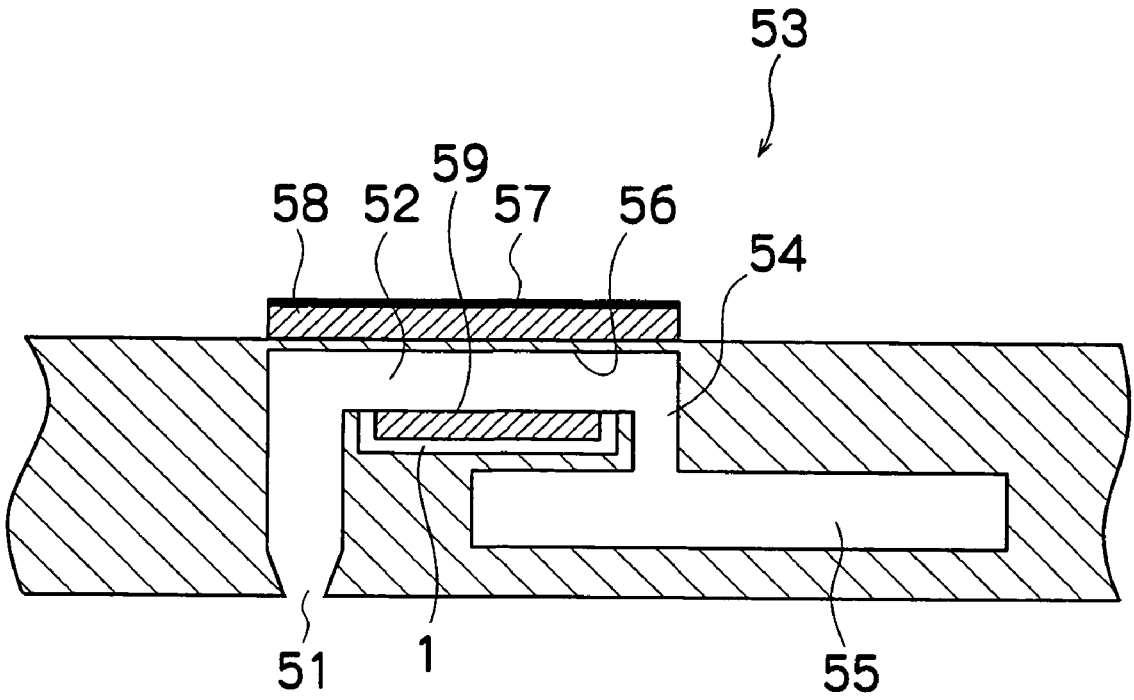
FIG. 4 is a cross-sectional view along line 4-4 in FIGS. 3A and 3B.

FIG. 3A is a perspective plan view showing an embodiment of the configuration of the print head 50, FIG. 3B is an enlarged view of a portion thereof, FIG. 3C is a perspective plan view showing another embodiment of the configuration of the print head 50, and FIG. 4 is a cross-sectional view taken along the line 4-4 in FIGS. 3A and 3B, showing the inner structure of an ink chamber unit. The nozzle pitch in the print head 50 should be minimized in order to maximize the resolution of the dots printed on the surface of the recording paper 16. As shown in FIGS. 3A and 3B, the print head 50 according to the present embodiment has a structure in which a plurality of ink chamber units 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 16 in a direction substantially perpendicular to the conveyance direction of the recording paper 16 is not limited to the embodiment described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

The planar shape of the pressure chamber 52 provided for each nozzle 51 is substantially a square, and the nozzle 51 and supply port 54 are disposed in both corners on a diagonal line of the square. Each pressure chamber 52 is connected to a common channel 55 through the supply port 54. The common channel 55 is connected to an ink supply tank 60 (not shown in FIG. 4, but shown in FIG. 5), which is a base tank that supplies ink, and the ink supplied from the ink supply tank is delivered through the common flow channel 55 in FIG. 4 to the pressure chambers 52.

A piezoelectric actuator 58 provided with an individual electrode 57 is bonded to a pressure plate 56 which forms the upper face of the pressure chambers 52 and also serves as a common electrode, and the piezoelectric actuator 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

On the other hand, when the pressure plate 56 receives pressure due to ejection or refilling of the ink, or the like, then distortion (stress) corresponding to this pressure occurs in a pressure sensor 59 (pressure measurement device) provided on the opposite side of the pressure chamber 52 from the piezoelectric actuator 58, and a voltage corresponding to this distortion (pressure change) can be obtained form the pressure sensor 59. A cavity section 1 is provided on the opposite side of the pressure sensor 59 from the pressure chamber 52, in such a manner that the displacement of the pressure sensor 59 is not impeded.

In the inkjet recording apparatus 10, it is possible to determine a pressure abnormality (a pressure wave abnormality) in the pressure chamber 52 by using the voltage obtained from the pressure sensor 59 as a measurement signal. The presence or absence of an ejection abnormality in the nozzle 51 of the pressure chamber 52 is determined on the basis of such a pressure abnormality.

Desirably, the piezoelectric actuator 58 and pressure sensor 59 shown in FIG. 4 are piezoelectric elements, made of PZT ($Pb(Zr,Ti)O_3$, lead zirconate titanate), or PVDF (polyvinylidene fluoride), or the like.

In general, for application of an ejection force, it is desirable to use a piezoelectric element having a large absolute value of the equivalent piezoelectric constant (d constant, electrical-mechanical conversion constant, piezoelectric strain constant) and excellent drive characteristics; and for pressure measurement, it is desirable to use a piezoelectric element having a large value of the piezoelectric output coefficient (g constant, mechanical-electrical conversion constant, piezoelectric stress constant) and excellent measurement characteristics. In other words, a ceramic piezoelectric material is suitable for a piezoelectric element having excellent driving characteristics, and a fluororesin type piezoelectric material, such as PVDF (polyvinylidene fluoride) or PVDF-TrFE (polyvinylidene fluoride-trifluoroethylene copolymer) is suitable for a piezoelectric element having excellent measurement characteristics. One embodiment of a ceramic piezoelectric material is PZT ($Pb(Zr,Ti)O_3$, lead zirconate titanate). PZT is mainly composed of lead titanate ($PbTiO_3$), which is a ferroelectric material, and lead zirconate ($PbZrO_3$), which is an antiferroelectric material, and it is possible to control various properties of PZT, such as the piezoelectricity, the dielectricity and the elastic characteristics, by changing the ratio in which these two components are combined.

The piezoelectric actuator 58 applying the ejection force to the ink inside the pressure chamber 52, and the pressure sensor 59 measuring the pressure inside the pressure chamber 52, are not restricted to being located in the positions shown in FIG. 4, and they may be arranged on the same wall of the pressure chamber 52, or on different walls of the pressure chamber 52. The details of the ejection abnormality determination control for determining an ejection abnormality on the basis of the above-described pressure (pressure variation) in the pressure chamber 52 are explained later.

As shown in FIG. 3B, the high-density nozzle head according to the present embodiment is achieved by arranging the plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which the plurality of ink chamber units 53 are arranged at a uniform pitch d in line with a direction forming the angle of θ with respect to the main scanning direction, the pitch P of the nozzles projected so as to align in the main scanning direction is $d \times \cos\theta$, and hence the nozzles 51 can be regarded to be equivalent to those arranged linearly at the fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction.

Configuration of Ink Supply System

Figure 5:
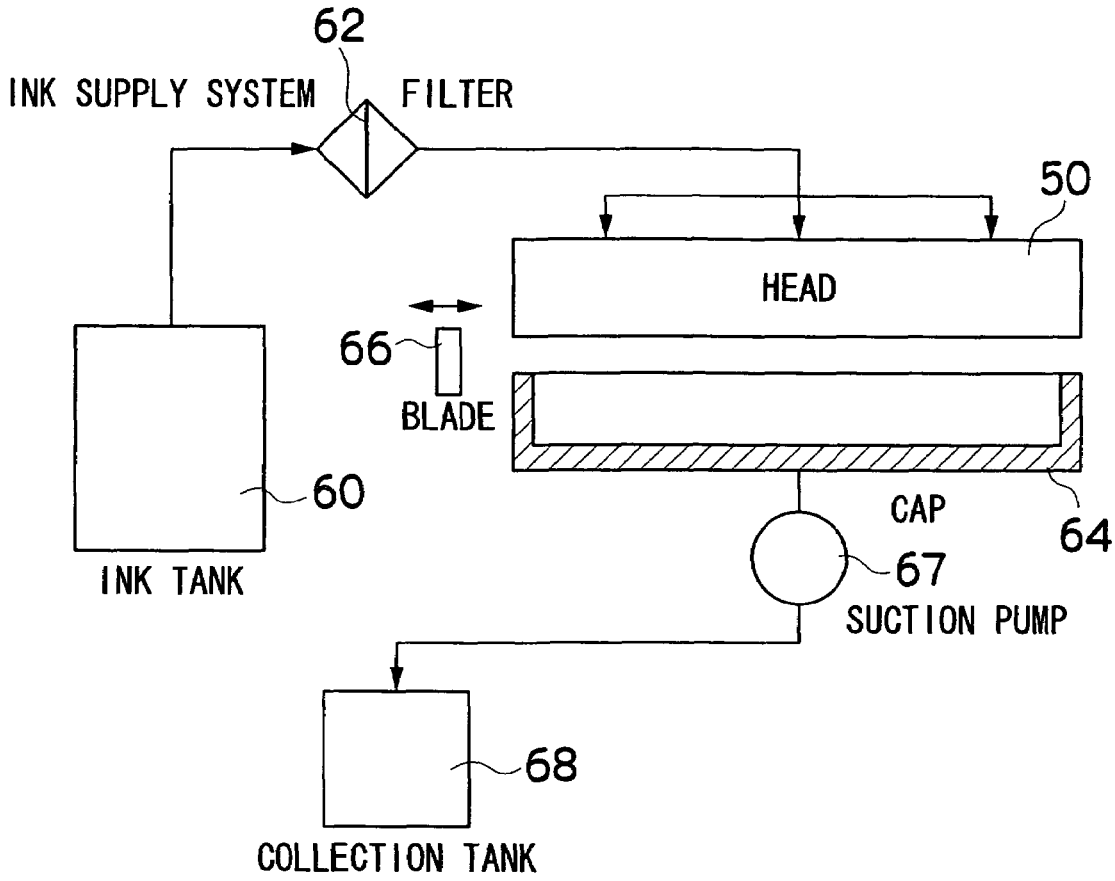
FIG. 5 is a schematic drawing showing the composition of an ink supply system in the inkjet recording apparatus.

FIG. 5 is a schematic drawing showing the configuration of the ink supply system in the inkjet recording apparatus 10. The ink supply tank 60 is a base tank that supplies ink to the print head 50 and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 5 is equivalent to the ink storing and loading unit 14 in FIG. 1 described above.

A filter 62 for removing foreign matters and bubbles is disposed between the supply ink tank 60 and the print head 50 as shown in FIG. 5. The filter mesh size in the filter 62 is preferably equivalent to or less than the diameter of the nozzle and commonly about 20 μm. Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face is thereby covered with the cap 64.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed into the ink inside the print head 50 (inside the pressure chambers 52), the cap 64 is placed on the print head 50, ink (ink in which bubbles have become intermixed) inside the pressure chambers 52 is removed by suction with a suction pump 67, and the ink removed by suction is sent to a collection tank 68. This suction operation is also carried out in order to remove degraded ink having increased viscosity (hardened ink), or degraded ink into which bubbles have become intermixed, when ink is loaded into the head for the first time, or when the print head 50 starts to be used after having been out of use for a long period of time, and when measuring errors due to deviations in the capacitance of the piezoelectric actuators 58.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the piezoelectric actuator 58 for the ejection driving is operated. Before reaching such a state (in a viscosity range that allows ejection by the operation of the piezoelectric actuator 58) the piezoelectric actuator 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a sucking action is carried out as follows.

More specifically, when bubbles have become intermixed in the ink inside the nozzle 51 and the pressure chamber 52, ink can no longer be ejected from the nozzle 51 even if the piezoelectric actuator 58 is operated. Also, when the ink viscosity inside the nozzle 51 has increased over a certain level, ink can no longer be ejected from the nozzle 51 even if the piezoelectric actuator 58 is operated. In these cases, a suction device to remove the ink inside the pressure chamber 52 by suction with a suction pump, or the like, is placed on the nozzle face of the print head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 6:
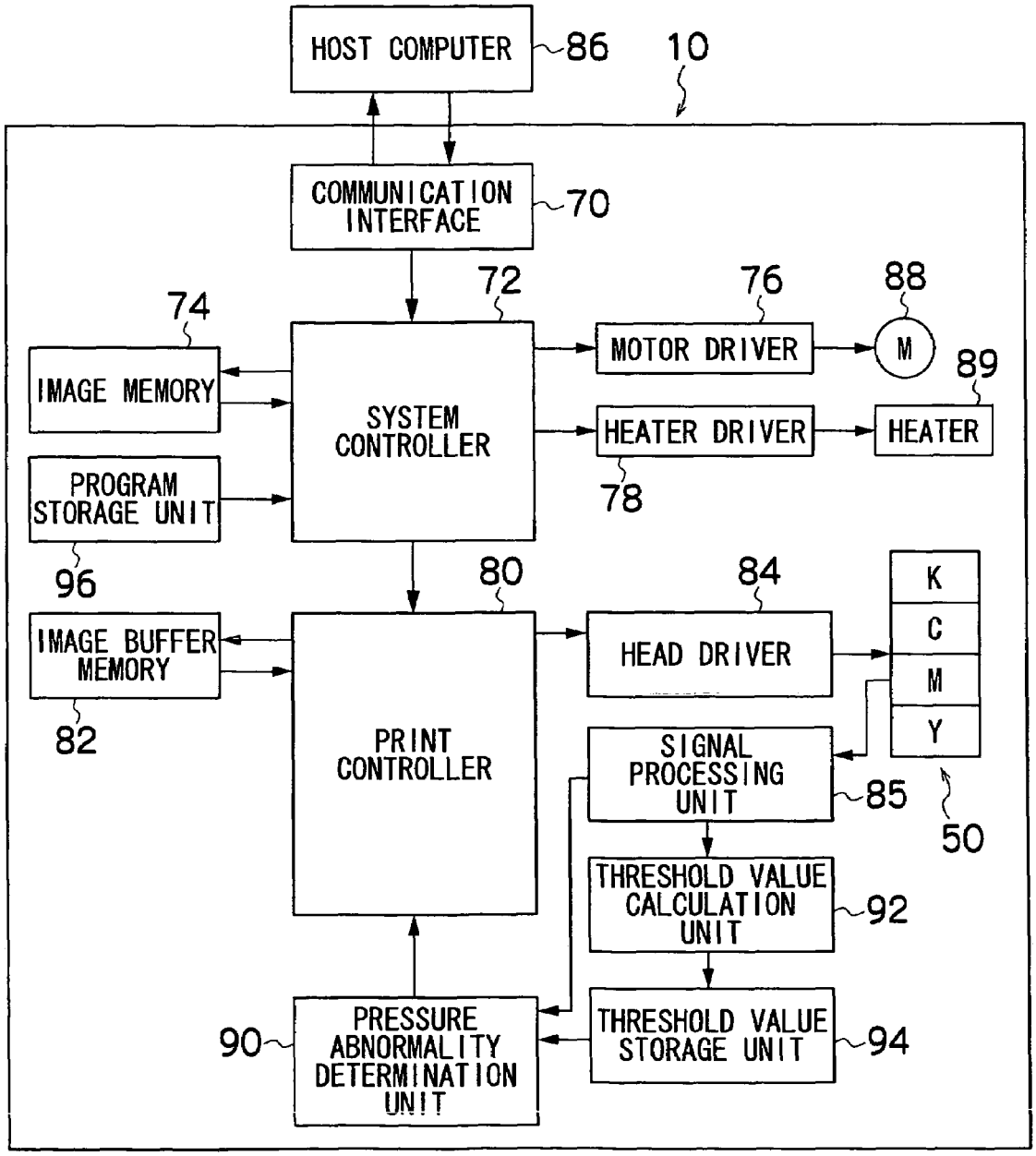
FIG. 6 is a principal block diagram showing the system composition of the inkjet recording apparatus.

FIG. 6 is a principal block diagram showing the system composition of the inkjet recording apparatus 10. The inkjet recording apparatus 10 comprises a communication interface 70, a system controller 72, an image memory 74, a motor driver 76, a heater driver 78, a print controller 80, an image buffer 82, a head driver 84, a signal processing unit 85, a pressure abnormality determination unit 90, a threshold value calculation unit 92, a threshold value storage unit 94, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74.

The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

An image buffer memory 82 is provided in the print controller 80, and image data, parameters, and other data are temporarily stored in the image buffer memory 82 when image data is processed in the print controller 80. Also possible is a mode in which the print controller 80 and the system controller 72 are integrated to form a single processor.

The head driver 84 drives the piezoelectric actuators 58 of the heads of the respective colors 12K, 12C, 12M and 1 2Y on the basis of print data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

The head driver 84 generates drive control signals for the print head 50 on the basis of the dot data stored in the image buffer memory 82. By supplying the drive control signals generated by the head driver 84 to the print head 50 ink is ejected from the print head 50. By controlling ink ejection from the print heads 50 in synchronization with the conveyance velocity of the recording paper 16, an image is formed on the recording paper 16.

The signal processing unit 85 carries out prescribed signal processes, such as noise reduction and amplification, with respect to the measurement signals obtained from the pressure sensors 59 shown in FIG. 4 in accordance with the pressure change in the pressure chambers 52 shown in FIG. 4. The measurement signal that has been subjected to signal processing by the signal processing unit 85 is supplied to the pressure abnormality determination unit 90, where the measurement signal is compared with a threshold value, which has been corrected to account for deviation in the capacitance of the pressure sensor 59, as determined by the threshold value calculation unit 92 and stored in the threshold value storage unit 94 (a corrected threshold value, or a threshold value for an ejection operation). The presence or absence of an ejection abnormality due to the occurrence of bubbles inside the pressure chamber 52 is determined on the basis of the result of this comparison.

Various control programs are stored in a program storage unit 96, and a control program is read out and executed in accordance with commands from the system controller 72. The program storage unit 96 may use a semiconductor memory, such as a ROM, EEPROM, or a magnetic disk, or the like. An external interface may be provided, and a memory card or PC card may also be used. Naturally, a plurality of these storage media may also be provided.

The program storage unit 96 may also be combined with a storage device for storing operational parameters, and the like (not shown).

Description of Ejection Abnormality Determination

Next, ejection abnormality determination according to the present embodiment is described in detail. In general, if a bubble occurs in a pressure chamber 52, pressure loss occurs in the pressure chamber 52, and the pressure change produced in the pressure chamber 52 is reduced. Hence, the pressure change in the pressure chamber 52 during an ejection operation is measured, and a pressure abnormality (excessive smallness) state, in which the pressure change is smaller than the pressure change during normal ejection, can be determined to indicate the occurrence of an ejection abnormality due to the presence of bubble inside the pressure chamber 52.

In the ejection abnormality determination (pressure abnormality determination) according to the present embodiment, prescribed signal processing (amplification, removal of noise components, etc) is carried out with respect to the measurement signal generated in the pressure chamber 52, and the measurement signal is compared with a previously set threshold pressure sensor 59 in accordance with the distortion produced by the pressure change in the value. If the measurement signal is greater than the threshold value, then this means that a prescribed pressure change has occurred in the pressure chamber 52, and it is therefore determined that ejection has been performed normally. On the other hand, if the measurement signal is equal to or smaller than the threshold value, then this means that the prescribed pressure change has not occurred in the pressure chamber 52, and therefore it is determined that an ejection abnormality has occurred.

The voltage produced by the pressure sensor 59 in accordance with the distortion of the pressure sensor 59 is dependent on the capacitance of the pressure sensor 59, and if there is deviation in this capacitance, then the voltage and frequency of the measurement signal obtained from the pressure sensor 59 also suffer deviation, and it becomes difficult to accurately measure the pressure change in the pressure chamber 52 (and hence to accurately determine the presence or absence of a pressure abnormality).

In general, the deviation in the capacitance of the pressure sensor 59 is considered in terms of manufacturing unevenness, and drift due to temperature change (deviation due to temperature change). In the present embodiment, the error in the capacitance of each of the pressure sensors 59 due to manufacturing unevenness is measured off-line (in other words, in a non-printing state when an ink ejection operation is not being performed on the basis of prescribed image data), and the threshold value used for determining the pressure abnormality is set for each of the pressure sensors 59, in accordance with the error thus measured. The threshold values of the pressure sensors 59 set in this way are stored in the threshold value storage unit 94 shown in FIG. 6, and the threshold values are read out as and when required. In the present embodiment, the error in the capacitance of each of the pressure sensors 59 due to manufacturing unevenness is measured immediately after processing for removing bubbles from the pressure chambers 52, by means of a suction operation. This process of measuring the errors and correcting the previously set threshold values is carried out when the apparatus is completed (upon inspection at assembly or shipment). Furthermore, if pressure sensors are used that produce changes in capacitance over time, then the aforementioned threshold value correction process is carried out suitably, over the passage of time.

On the other hand, the drifts in the capacitance of the pressure sensors 59 due to temperature change are measured in real time, while the apparatus is on-line (during an ejection operation in which an ink ejection operation is carried out on the basis of the prescribed image data), and the threshold values used for determining ejection abnormality are altered in accordance with the drifts in the capacitance thus measured (namely, the deviation due to temperature change). Consequently, it is possible to achieve satisfactory determination of pressure abnormality, which takes account of deviations in the capacitance of the pressure sensors 59 due to manufacturing unevenness and temperature change.

Figure 7:
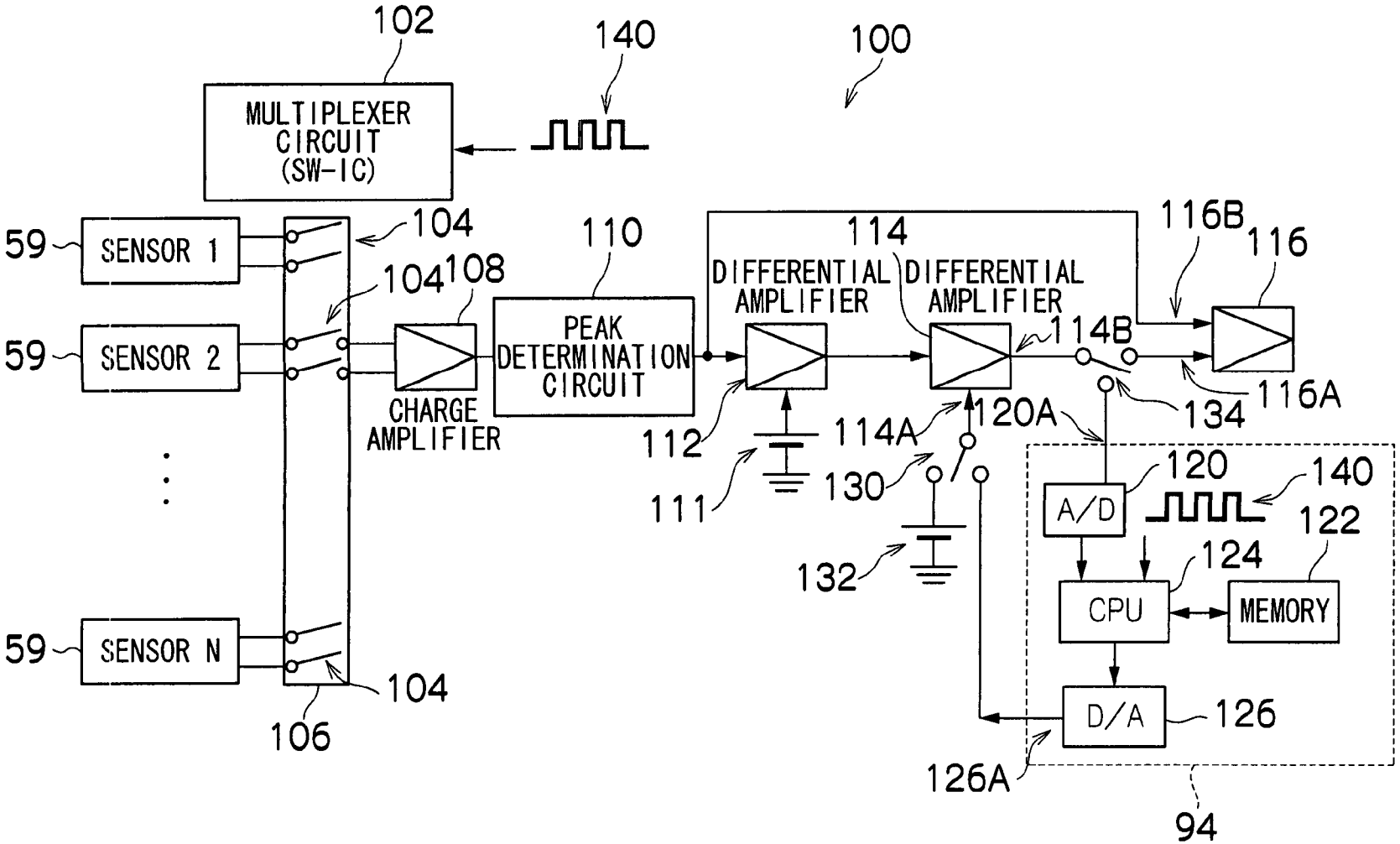
FIG. 7 is a block diagram showing the composition of an ejection abnormality determination unit in the inkjet recording apparatus.

FIG. 7 shows the general composition of an ejection abnormality determination unit 100. The ejection abnormality determination unit 100 shown in FIG. 7 includes the signal processing unit 85, the pressure abnormality determination unit 90, the threshold value calculation unit 92, and the threshold value storage unit 94 shown in FIG. 6.

As shown in FIG. 7, the signal processing unit 85 in FIG. 6 comprises: a switch array (selection device) 106 having a plurality of switching elements 104, which selectively switch the pressure sensor 59 from which a measurement signal is obtained, by means of a multiplexer circuit 102; a charge amplifier 108, which amplifies the measurement signal having a very weak voltage obtained from the pressure sensor 59; and a peak determination (peak hold) circuit 110, which determines the peak value of the measurement signal amplified by the charge amplifier 108. The threshold value calculation unit 92 in FIG. 6 comprises: a differential amplifier (error extracting device) 112, which extracts the error of the peak value determined by the peak determination circuit 110, with respect to a central design value (a voltage corresponding to the nominal value of the capacitance of the pressure sensor 59, in other words, a voltage corresponding to an error-free theoretical value of the capacitance) outputted by a central design value output device 111; and a differential amplifier 114, which adds (or subtracts) the error extracted by the differential amplifier 112 to (or from) the prescribed threshold value.

The threshold value storage unit 94 in FIG. 6 comprises: an A/D converter 120, which converts an analog signal outputted from the differential amplifier 114 into a digital signal (digital data); a memory 122, which stores a threshold value converted to digital data by the A/D converter 120; a CPU 124, which functions as a memory controller for controlling the writing and reading of data, to and from the memory 122; and a D/A converter 126, which converts the digital data corresponding to a threshold value read out from the memory 122 through the CPU 124, into an analog signal. The pressure abnormality determination unit 90 in FIG. 6 comprises a determination unit (pressure abnormality determination device) 116, which is a comparator for determining an ejection abnormality by comparing the output value of the peak determination circuit 110 with the sum of the threshold value plus the error in the capacitance of the pressure sensor 59 as outputted by the differential amplifier 114. The system controller 72 or the processor included in the print controller 80 shown in FIG. 6 may also serve as the CPU 124.

When measuring the amount of deviations in the capacitance of the pressure sensors 59 due to manufacturing unevenness (in other words, during a non-printing state), a switch (input switching device) 130 is switched in such a manner that a threshold reference value output device 132, which outputs a voltage corresponding to a threshold reference value, is connected with the input section (reference input section) 114A of the differential amplifier 114. Moreover, a switch (output switching device) 134 is switched in such a manner that the output section 114B of the differential amplifier 114 is connected to the input section 120A of the A/D converter 120.

On the other hand, when measuring the amount of deviations in the capacitance of the pressure sensors 59 due to temperature change, the switch 130 is switched in such a manner that the output 126A of the D/A converter 126 is connected with the input section 114A of the differential amplifier 114. Moreover, the switch 134 is switched in such a manner that the output section 114B of the differential amplifier 114 is connected to the input section 116A of the determination unit 116.

Next, the measurement of the errors in the capacitance of the pressure sensors 59 due to manufacturing unevenness, and the method of calculating the threshold values (corrected threshold values) on the basis of theses errors in the capacitance, are described in detail. As described above, firstly, the switch 130 is switched in such a manner that the threshold reference value output device 132 is connected to the input section 114A of the differential amplifier 114, and furthermore, the switch 134 is switched in such a manner that the output section 114B of the differential amplifier 114 is connected to the input section 120A of the A/D converter 120.

Thereupon, the cap 64 shown in FIG. 5 is abutted against the ejection surface of the print head 50, the suction pump 67 is operated, and the ink inside the nozzles 51 and the pressure chambers 52 is sucked, so that the bubbles and degraded ink are removed from the nozzles 51 and the pressure chambers 52.

When the bubbles and degraded ink inside the nozzles 51 and the pressure chambers 52 have been thus removed, new ink is filled into the pressure chambers 52, pressure waves in a normal state (free of bubbles) are generated in the pressure chambers 52 by operating the piezoelectric actuators 58, and the generated pressure waves in the pressure chambers 52 are sensed by the pressure sensors 59 provided in the pressure chambers 52, respectively.

More specifically, the piezoelectric actuators 58 are driven in synchronism with a sampling clock signal (a control signal which controls the switching timings of the switching elements 104) 140 inputted to the multiplexer circuit 102, and the pressures in the pressure chambers 52 are measured by time division, by the pressure sensors 59.

Figure 8A:
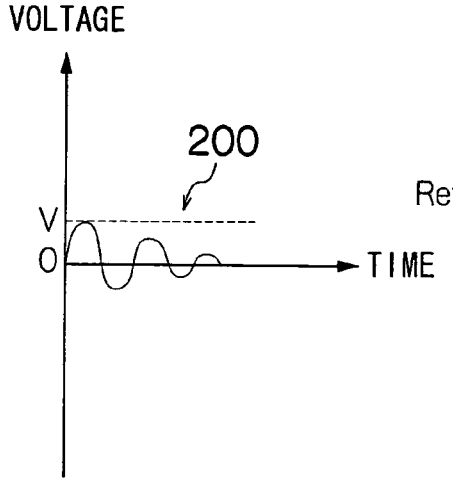
FIGS. 8A to 8E are diagrams illustrating a measurement signal.
Figure 8D:
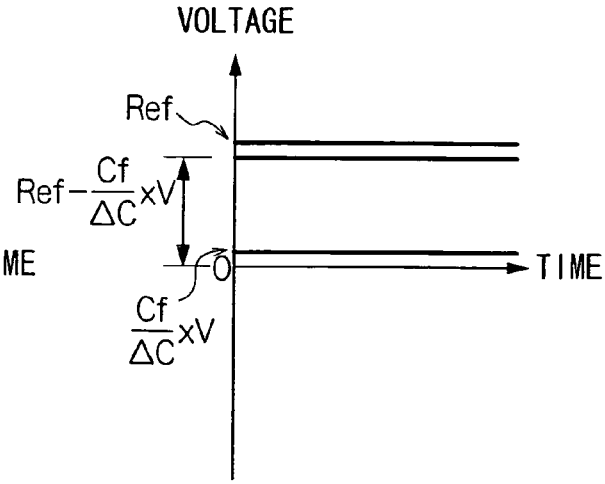
Figure 8B:
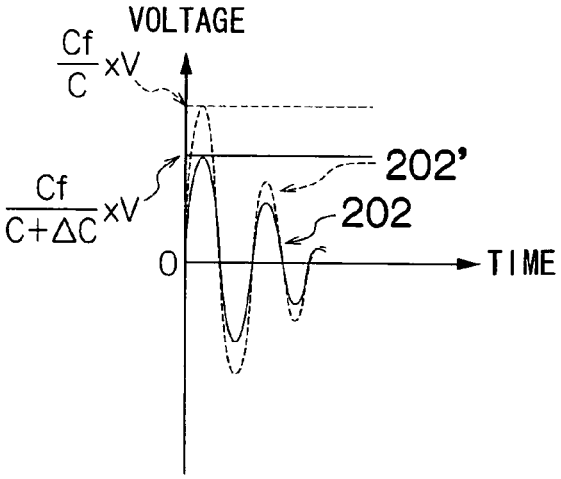
Figure 8E:
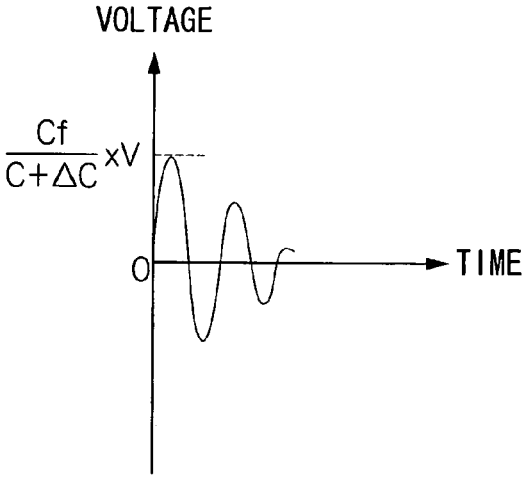

The measurement signal (measurement waveform) 200 (see FIG. 8A) thereby obtained from each of the pressure sensors 59 is a very weak signal (a signal having an extremely weak peak voltage V), and it is amplified at a prescribed rate of amplification by the charging amplifier 108 (see FIG. 8B), and then supplied to the peak determination circuit 110 as the amplified measurement signal 202. The peak determination circuit 110 determines the peak voltage (maximum voltage value) (see FIG. 8C) of the measurement signal 202. A desirable mode is one in which a noise filter circuit is provided before the charge amplifier 108 amplifying the measurement signal 200. This noise filter circuit may suitably combine a low-pass filter, bandpass filter, and the like.

The measurement signal 202 is affected by an error component AC in the capacitance of the pressure sensor 59, which occurs due to manufacturing unevenness. The error component $\Delta C$ is extracted by the differential amplifier 112 from the measurement signal 202 affected by the error component AC (see FIG. 8B) and the central design value ($(Cf\times V)/C$ in FIG. 8B) outputted by the central design value output device 111 (see FIG. 7) that is not affected by the error $\Delta C$.

The peak voltage (volt (V)) of the measurement signal 202 is expressed as $(Cf\times V)/(C+\Delta C)$, where $\Delta C$ (farad (F)) is the error in the capacitance of the pressure sensor 59 due to manufacturing unevenness, Cf is the circuit constant which sets the rate of amplification of the charge amplifier 108, and C (farad (F)) is the capacitance of a pressure sensor having an ideal capacitance value without any error $\Delta C$. The peak voltage of the measurement signal 202' (drawn with the broken line in FIG. 8B) obtained from the pressure sensor having the ideal capacitance without any error $\Delta C$, is $(Cf\times V)/C$. In other words, the peak voltage of the measurement signal 202' obtained from the pressure sensor having the ideal capacitance without any error $\Delta C$, is used as the central design value outputted by the central design value output device 111, and in the differential amplifier 112, the error voltage $(Cf\times V)/\Delta C$ between the central design value and the peak voltage $(Cf\times V)/(C+\Delta C)$ of the measurement signal 202 obtained from each of the pressure sensors 59, is extracted.

Furthermore, in the differential amplifier 114 on the stage after the differential amplifier 112, the corrected threshold value, which is corrected for the error in each of the pressure sensors 59 due to manufacturing unevenness, is obtained by calculating a difference between the error voltage $(Cf\times V)/\Delta C$ extracted by the differential amplifier 112, and the threshold reference value Ref, which is a reference of the determination and is outputted from the threshold reference value output device 132. The corrected threshold value is expressed as $\{Ref-(Cf\times V)/\Delta C\}$ (see FIG. 8D).

The corrected threshold value thus obtained is converted into a digital signal (digital data) by the A/D converter 120, and then stored in the memory 122. In the memory 122, the relationship between the pressure sensors and the corrected threshold values are stored in the form of a data table. In order to achieve synchronism between the write timing of the corrected threshold value data and the operation of the multiplexer circuit 102 shown in FIG. 7, the sampling clock signal 140 is supplied to the CPU 124.

The ejection abnormality determination is performed on the basis of the pressures generated in the pressure chambers 52 by using the corrected threshold values thus obtained, and therefore, desirable ejection abnormality determination is performed, in which the capacitance of the pressure sensors 59 has been corrected.

On the other hand, during a printing operation (during normal ejection), the switch 134 is switched in such a manner that the output section 114B of the differential amplifier 114 is connected to the input section 116A of the determination unit 116. The pressure waves in the pressure chambers 52 are sensed by time division, by the pressure sensors 59 provided in the pressure chambers 52.

During a printing operation, when the temperature in the pressure chamber 52 is changed at the ink refilling timing, or the like, the capacitance of the pressure sensor 59 adjacent to the pressure chamber 52 is affected by the temperature change in the pressure chamber 52 and thereby contains an error component ΔC'. Hence, the measurement signal 200 (see FIG. 8A) is affected by the error component ΔC' in the capacitance of the pressure sensor 59, which occurs due to the temperature change. The following description is made with reference to FIGS. 8A to 8E, in which ΔC is read as ΔC' (farad (F)).

Figure 8C:
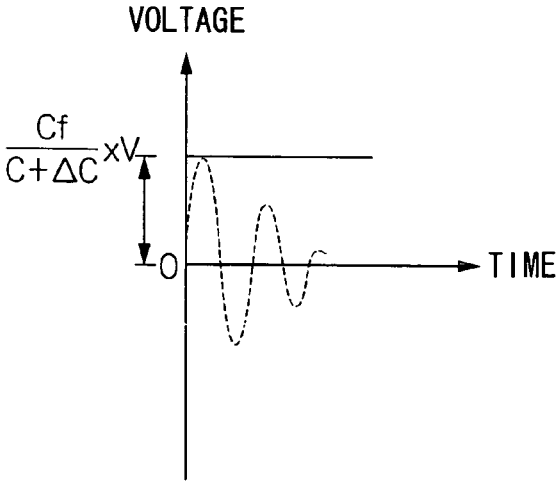

The charge amplifier 108 amplifies the measurement signal 200 and outputs the amplified measurement signal 202 (see FIG. 8B), and the peak determination circuit 110 determines the peak voltage of the measurement signal 202 (see FIG. 8C). The peak voltage (volt (V)) of the measurement signal 202 is expressed as (Cf×V)/(C+ΔC'), where ΔC' (farad (F)) is the error in the capacitance of the pressure sensor 59 due to the temperature change, Cf is the circuit constant which sets the rate of amplification of the charge amplifier 108, and C (farad (F)) is the capacitance of a pressure sensor 59 having an ideal capacitance value without any error ΔC.

The peak voltage is inputted to the input section 116B of the determination unit 116 (see FIG. 7), and is also inputted to the differential amplifier 112.

The differential amplifier 112 extracts the error component of the inputted peak voltage with reference to the central design value outputted by the central design value output device 111, and the differential amplifier 114 subtracts the voltage corresponding to the error component, from the corrected threshold value for the pressure sensor 59 (corresponding to Ref in FIG. 8D), which is read out from the memory 122. Thereby, the temperature-compensated threshold value (threshold value during ejection), which has been corrected to account for deviation in the capacitance due to the temperature drift, is supplied to the input section 116A of the determination unit 116, from the output section 114B of the differential amplifier 114.

In the determination unit 116, the measurement voltage (peak voltage) sent from the peak determination circuit 110, which is affected by the error due to the temperature change, is compared with the temperature-compensated threshold value. If the measurement voltage is greater than the temperature-compensated threshold value, then it is determined that ejection has been performed normally, whereas if the measurement voltage is equal to or lower than the temperature-compensated threshold value, then it is determined that an ejection abnormality has occurred.

FIGS. 8A to 8E show a case where the capacitance of the pressure sensor becomes larger than the nominal value C, and FIGS. 9A to 9E show a case where the capacitance of the pressure sensor becomes smaller than the nominal value C. In FIGS. 9A to 9E, items which are the same as or similar to those in FIGS. 8A to 8E are denoted with the same reference numerals and description thereof is omitted here. In the following description, ΔC, which represents the error in the capacitance of the pressure sensor 59 due to manufacturing unevenness, is appropriately read as ΔC', which represents the error in the capacitance of the pressure sensor 59 due to temperature change.

Figure 9A:
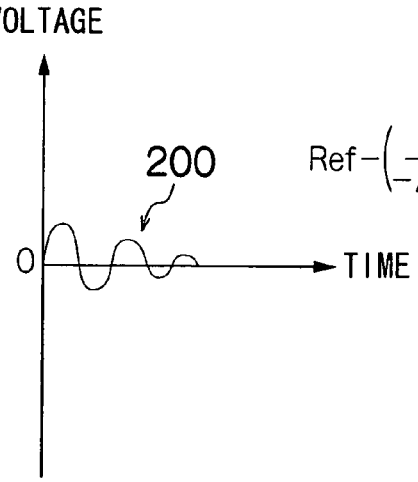
FIGS. 9A to 9E are diagrams showing a measurement signal in a case where the error in the capacitance is negative.
Figure 9D:
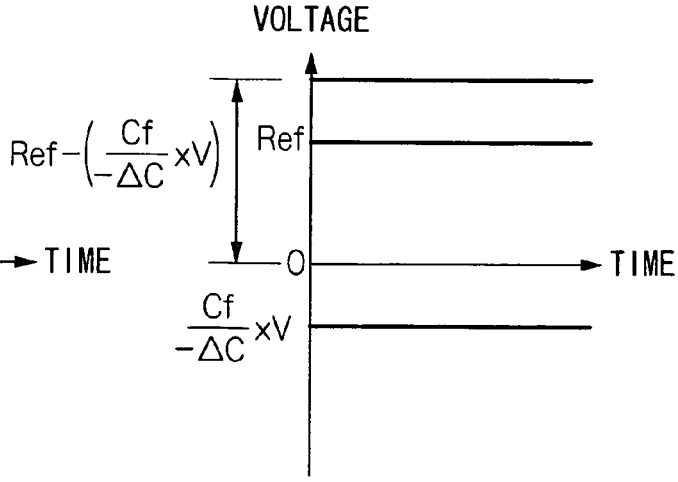
Figure 9B:
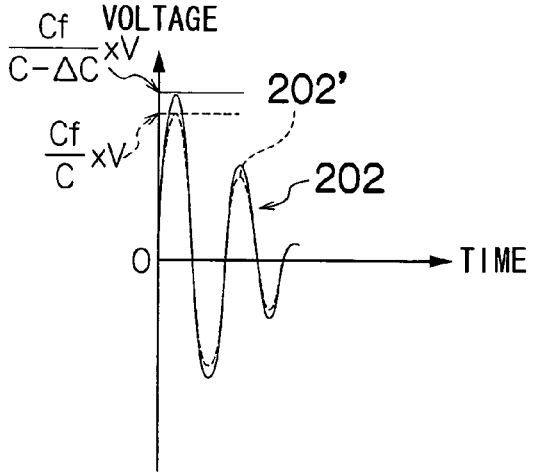
Figure 9E:
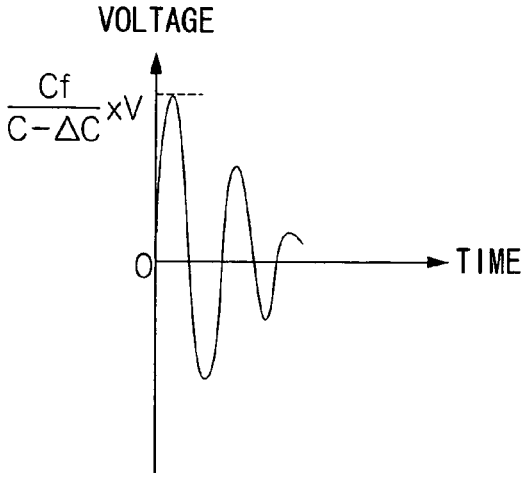
Figure 9C:
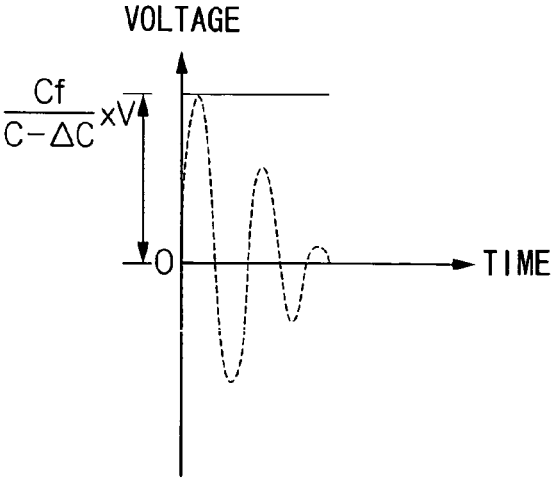

If the actual capacitance of the pressure sensor 59 is lower than the nominal value, then as shown in FIGS. 9B and 9C, a peak voltage (Cf×V)/(C−ΔC) is determined, which is greater than a case where there is no error ΔC, and the error voltage extracted by the differential amplifier 112 is (Cf×V)/(−ΔC), as shown in FIG. 9D.

The corrected threshold value (or the temperature-compensated threshold value) outputted from the differential amplifier 114 is {Ref−(Cf×V)/(−ΔC)} (see FIG. 9D). When the ejection abnormality is determined on-line, the measurement voltage (Cf×V)/(C−ΔC) shown in FIG. 9E inputted from the peak determination circuit 110 to the determination unit 116 is compared with the temperature-compensated threshold value, and if the measurement voltage is greater than the temperature-compensated threshold value, then it is determined that normal ejection has been performed, whereas if the measurement voltage is equal to lower than the temperature-compensated threshold value, then it is determined that an ejection abnormality has occurred.

Figure 10:
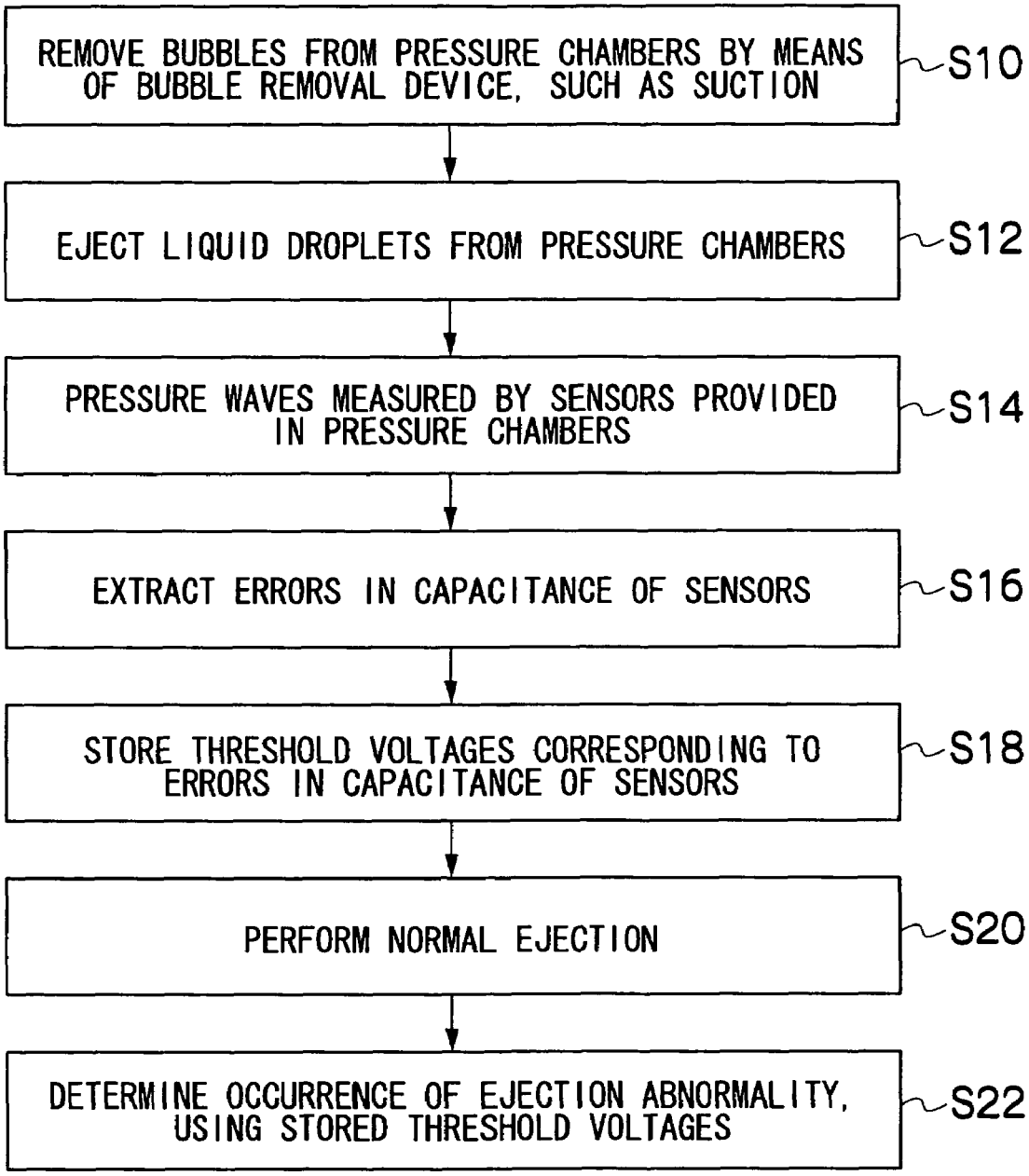
FIG. 10 is a flowchart showing the sequence of correctional control for unevenness in pressure sensors.
Figure 11:
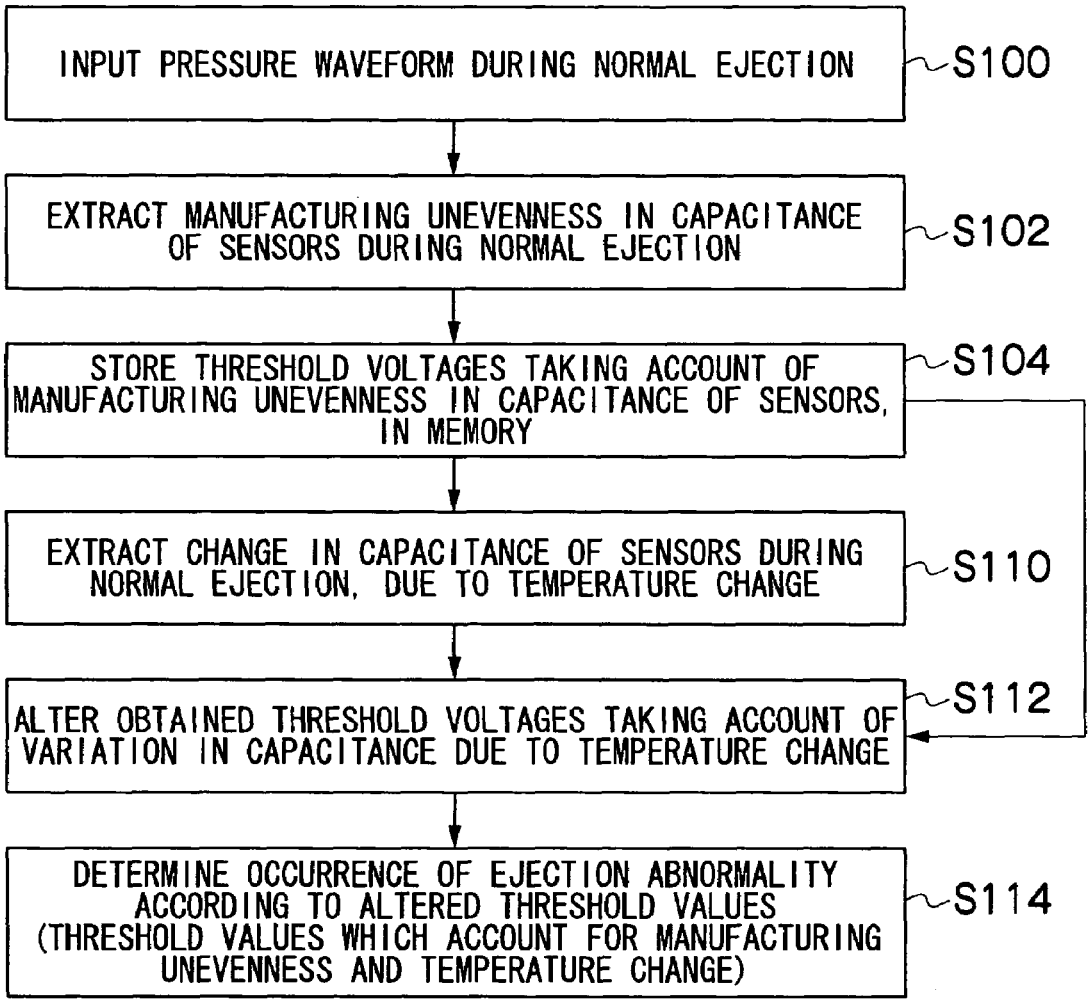
FIG. 11 is a flowchart showing the sequence of temperature compensation control in pressure sensors.

FIGS. 10 and 11 are flowcharts showing the control sequence of the ejection abnormality determination process described above. FIG. 10 is a flowchart of a control procedure for determining the deviation in the capacitance of each of the pressure sensors 59 in a state where there are no bubbles, and setting a threshold value for use in determining ejection abnormality, for each of the pressure sensors 59. Here, the principal factor in the deviations in the capacitance of the pressure sensors 59 is unevenness that arises during manufacture.

As shown in FIG. 10, firstly, bubbles are removed from the pressure chambers 52 in the print head 50, by means of suction (step S10). In this bubble removal step, the cap 64 shown in FIG. 6 is placed against the nozzle surface of the print head 50, and the ink inside the pressure chambers 52 is sucked by generating a negative pressure by means of the suction pump 67. When the suction in the bubble removal step has been completed, new ink (which contains no bubbles) is refilled into the pressure chambers 52.

When the ink refilling has been completed and the bubble removal step has finished, an ejection operation is immediately performed by driving the piezoelectric actuators 58 (step S12), and the pressures occurring in the pressure chambers 52 during the ejection step in step S12 are measured (step S14). Here, when it is stated that the ejection operation and the pressure measurement are carried out "immediately" after the bubble removal step, then this means that the ejection operation and the pressure measurement are performed within several minutes after the bubble removal step. After the bubble removal step, if a temperature change occurs in the ambient environment of the print head 50, with the passage of time, and if the limit value of the dissolved oxygen content (dissolved gas content) in the ink inside the pressure chambers 52 is exceeded, then bubbles occur in the ink. Moreover, it is also possible that bubbles are introduced into the pressure chambers 52 from the meniscus.

After the pressure measurement in step S14, the errors in the capacitance of the pressure sensors are extracted (step S16). The default threshold value is corrected on the basis of the errors in the capacitance of the pressure sensors extracted by the error extraction in step S16, and the corrected threshold values are then stored in a prescribed storage medium (e.g., the memory 122 shown in FIG. 7) (step S18). Here, the "default threshold value" is previously determined on the basis of the theoretical value of the capacitance (i.e., an ideal capacitance value having no error) of the pressure sensors (e.g., the central design value outputted by the central design value output device 111 described above with reference to FIG. 7).

After performing ejection (normal ejection) (step S20) on the basis of the corrected threshold values thus obtained, the ejection abnormality (pressure abnormality) is determined in the pressure abnormality determination step (step S22).

Moreover, during the normal ejection operation, correction (temperature compensation) is also performed in respect of the deviations in the capacitance values of the pressure sensors caused by temperature change. FIG. 11 shows a flowchart of this correction control procedure. As shown in FIG. 11, firstly, a pressure waveform is inputted during normal ejection, and the pressure is measured in step S100. Then, the manufacturing errors in the capacitance values of the pressure sensors are extracted during the normal ejection operation (step S102). After the error extraction step in step S102, the threshold voltages that take account of the manufacturing unevenness extracted (determined) at step S102 (namely, the corrected threshold values) are stored in the memory 122 shown in FIG. 7 (step S104 in FIG. 11). Here, the term "during the normal ejection" means a state that the pressure chambers 52 do not contain any bubble (in other words, the pressure chambers 52 filled with ink immediately after the suction operation). Thereby, the corrected threshold values are obtained during the non-printing state, by means of step S100 to step S104 in FIG. 11.

Furthermore, during the printing operation, the amount of deviations in the capacitance of the pressure sensors due to temperature change during printing are extracted (step S110). The temperature-compensated threshold values are obtained on the basis of the corrected threshold values stored in the memory 122 in FIG. 7 at step S18 in FIG. 10, by taking account of the amounts of variation in the capacitance of the pressure sensors due to the temperature change extracted in the temperature error extraction step at step S110 in FIG. 11 (step S112). The occurrence of an ejection abnormality, including an ejection failure, is determined in an ejection abnormality determination step (step S114), on the basis of the temperature-compensated threshold values obtained in the temperature-compensated threshold value calculation step at step S112.

Here, the term "during normal ejection" means a state where a task for forming a desired image onto recording paper 16 is being carried out (including both a state where ink ejection is being performed, and a non-ejection period, such as an interval between images). In this state, there is a possibility that bubbles may occur inside the pressure chambers 52, and ejection abnormality may arise when bubbles occur in the pressure chambers 52.

In the inkjet recording apparatus 10 having the composition described above, the threshold value that has been corrected to account for the deviation in the capacitance due to manufacturing unevenness is obtained for each of the pressure sensors 59 provided in the pressure chambers 52, and the occurrence of a pressure abnormality (ejection abnormality) is determined in each of the pressure chambers 52, on the basis of the threshold value corresponding to the pressure sensor of that pressure chamber. In other words, ejection abnormality is determined on the basis of the corrected threshold values that are different for the pressure sensors, rather than using a fixed threshold value, and therefore satisfactory ejection abnormality determination is performed, which takes account of the errors (deviations) in the respective elements (pressure sensors 59).

Furthermore, since the threshold values used for determining ejection abnormality are varied on-line, in accordance with the amounts of change in the capacitance due to the temperature drift, then satisfactory determination of abnormality is performed, by taking account of the deviations in the capacitance that are affected by the constantly changing temperature.

Since the measurement signals are also affected by errors (drift) due to temperature change in the pressure chambers 52 and the pressure sensors 59, then desirably, temperature compensation circuits are added to the determination circuits (for example, the charge amplifier 108 and the peak determination circuit 110 in FIG. 7).

The aforementioned embodiments are described with respect to the inkjet recording apparatus used for color printing by means of a plurality of colors of ink, but the present invention may also be applied to an inkjet recording apparatus used for monochrome printing.

Moreover, in the foregoing explanation, the inkjet recording apparatus is described as one embodiment of an image forming apparatus, but the scope of application of the present invention is not limited to this. For example, the drive apparatus of a liquid ejection head, and the liquid ejection apparatus according to the present invention may also be applied to a photographic image forming apparatus in which developing solution is applied to a printing paper by means of a non-contact method. Furthermore, the scope of application of the driving apparatus for a liquid ejection head and the liquid ejection apparatus according to the present invention is not limited to an image forming apparatus, and the present invention may also be applied to various other types of apparatuses which eject a processing liquid, or other liquid, toward an ejection receiving medium by means of a liquid ejection head (such as a coating device, wiring pattern printing device, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head having a nozzle which ejects liquid, a pressure chamber which is provided correspondingly to the nozzle, and a pressure measurement device which is provided correspondingly to the pressure chamber and measures pressure in the pressure chamber;

a bubble removal device which removes a bubble from the pressure chamber;

an error extraction device which extracts an error in capacitance of the pressure measurement device of the pressure chamber from which the bubble has been removed by the bubble removal device;

a threshold value setting device which sets a corrected threshold value to be used for determination of pressure abnormality in the pressure chamber, the corrected threshold value having been corrected for the error in the capacitance of the pressure measurement device extracted by the error extraction device;

a storage device which stores the corrected threshold value set by the threshold value setting device; and a pressure abnormality determination device which performs the determination of the pressure abnormality in the pressure chamber, according to a result of comparison between a measurement result obtained from the pressure measurement device and the corrected threshold value read out from the storage device.

2. The liquid ejection apparatus as defined in claim 1, wherein the pressure measurement device comprises a piezoelectric element.

3. The liquid ejection apparatus as defined in claim 1, wherein:

the threshold value setting device comprises: a reference value input section to which a reference value is inputted; an error input section to which the error in the capacitance of the pressure measurement device extracted by the error extraction device is inputted; and an output section which outputs the corrected threshold value obtained by calculating according to the reference value inputted to the reference value input section and the error inputted to the error input section; and the liquid ejection apparatus further comprises:

an input switching device which switches the reference value inputted to the reference value input section;

an output switching device which switches destination of the corrected threshold value outputted by the output section; and a switching control device which, during an ejection operation for ejecting the liquid from the nozzle in accordance with prescribed ejection data, controls the input switching device in such a manner that the corrected threshold value read out from the storage device is inputted to the reference value input section, and controls the output switching device in such a manner that a threshold value during the ejection operation outputted from the output section calculated according to the corrected threshold value inputted to the reference value input section and the error in the capacitance of the pressure measurement device during the ejection operation extracted by the error extraction section, is inputted to the pressure abnormality determination section.

4. A liquid ejection apparatus, comprising:

a liquid ejection head having a plurality of nozzles which eject liquid, a plurality of pressure chambers which are provided correspondingly to the nozzles, and a plurality of pressure measurement devices which are provided correspondingly to the pressure chambers and measure pressure in the pressure chambers;

a selection device which selectively switches the pressure measurement devices from which measurement signals are obtained;

a bubble removal device which removes bubbles from the pressure chambers;

an error extraction device which extracts errors in capacitance of the pressure measurement devices of the pressure chambers from which the bubbles have been removed by the bubble removal device;

a threshold value setting device which sets corrected threshold values to be used for determination of pressure abnormality in the pressure chambers, the corrected threshold values having been corrected for the errors in the capacitance of the pressure measurement devices extracted by the error extraction device;

a storage device which stores the corrected threshold values set by the threshold value setting device; and a pressure abnormality determination device which performs the determination of the pressure abnormality in the pressure chambers, according to results of comparison between measurement results obtained from the pressure measurement devices and the corrected threshold values read out from the storage device.

5. The liquid ejection apparatus as defined in claim 4, wherein each of the pressure measurement devices comprises a piezoelectric element.

6. The liquid ejection apparatus as defined in claim 4, wherein:

the threshold value setting device sets the corrected threshold values to be used for the determination of the pressure abnormality for the pressure measurement devices, respectively; and the storage device stores the corrected threshold values set for the pressure measurement devices, respectively.

7. The liquid ejection apparatus as defined in claim 4, wherein:

the threshold value setting device comprises: a reference value input section to which a reference value is inputted; an error input section to which the errors in the capacitance of the pressure measurement devices extracted by the error extraction device are inputted; and an output section which outputs the corrected threshold values obtained by calculating according to the reference value inputted to the reference value input section and the errors inputted to the error input section; and the liquid ejection apparatus further comprises:

an input switching device which switches the reference value inputted to the reference value input section;

an output switching device which switches destination of the corrected threshold values outputted by the output section; and a switching control device which, during an ejection operation for ejecting the liquid from the nozzles in accordance with prescribed ejection data, controls the input switching device in such a manner that the corrected threshold values read out from the storage device are inputted to the reference value input section, and controls the output switching device in such a manner that threshold values during the ejection operation outputted from the output section calculated according to the corrected threshold values inputted to the reference value input section and the errors in the capacitance of the pressure measurement devices during the ejection operation extracted by the error extraction section, are inputted to the pressure abnormality determination section.

8. An ejection abnormality determination method for a liquid ejection head having a nozzle which ejects liquid, a pressure chamber which is provided correspondingly to the nozzle, and a pressure measurement device which is provided correspondingly to the pressure chamber and converts pressure in the pressure chamber into a pressure measurement signal, the method comprising:

a bubble removal step of removing a bubble from the pressure chamber;

an error extraction step of extracting an error in capacitance of the pressure measurement device of the pressure chamber from which the bubble has been removed in the bubble removing step;

a threshold value setting step of setting a corrected threshold value to be used for determination of pressure abnormality in the pressure chamber, according to the error in the capacitance of the pressure measurement device extracted in the error extraction step;

a storage step of storing the corrected threshold value set in the threshold value setting step;

a pressure measurement step of measuring pressure in the pressure chamber by the pressure measurement device; and a pressure abnormality determination step of performing the determination of the pressure abnormality in the pressure chamber, according to a result of comparison between a measurement result obtained in the pressure measurement step and the corrected threshold value stored in the storage step.

* * * * *